United States Patent [19]

Grandjean

[11] 4,324,949

[45] Apr. 13, 1982

[54] CONNECTOR FOR CONNECTING ELECTRIC CONDUCTORS TOGETHER

[75] Inventor: René Grandjean, Blagny, France

[73] Assignee: Mars-Actel, Paris, France

[21] Appl. No.: 142,955

[22] Filed: Apr. 23, 1980

[30] Foreign Application Priority Data

Apr. 26, 1979 [FR] France ..... 79 10658

[51] Int. Cl.[3] ..... H01R 4/20

[52] U.S. Cl. ..... 174/71 R; 174/84 C; 403/305

[58] Field of Search ..... 174/71 R, 84 C; 403/305; 248/214, 317

[56] References Cited

U.S. PATENT DOCUMENTS

| | | | |
|---|---|---|---|
| 2,841,255 | 7/1958 | Kemp | 248/317 X |
| 3,036,147 | 5/1962 | Wheaton et al. | 174/84 C |
| 3,165,575 | 1/1965 | Lynch, Jr. et al. | 174/84 C |
| 3,544,956 | 12/1970 | Bricker | 174/71 R X |
| 3,588,791 | 6/1971 | Polidori | 174/71 R X |

FOREIGN PATENT DOCUMENTS 892423 3/1962 United Kingdom .

*Primary Examiner*—B. A. Reynolds
*Assistant Examiner*—D. A. Tone
*Attorney, Agent, or Firm*—Sughrue, Mion, Zinn, Macpeak & Seas

[57] ABSTRACT

The connector connects two electric conductors together in a sealed manner, providing dielectric continuity of the conductor insulation as well as conductive continuity of the conductors. Said connector comprises a connector sleeve (2) having a conductive portion (21) made of a malleable material and a cavity (23) for accommodating a bared end portion (5) of a conductor as well as an adjacent insulated portion of said conductor. The sleeve (2) is covered by an insulating covering (6) which completely surrounds the conductive portion (21) and is folded over at the ends to line those parts of the cavity (23) which receive insulated portions of the conductors to be joined.

6 Claims, 6 Drawing Figures

CONNECTOR FOR CONNECTING ELECTRIC CONDUCTORS TOGETHER

The invention relates to a connector for connecting electric conductors together. It may be used in particular for connecting insulated drop wire conductors to an overhead cable.

BACKGROUND OF THE INVENTION

In such an application it is usual to employ a connector which includes an aluminium sleeve crimped onto the cable. However, such an arrangement which is not insulated, does not allow sealed connection to be achieved and it is observed that moisture runs along the strands of the cable right up into the connecting sleeve.

OBJECT OF THE INVENTION

The invention aims to produce a pre-insulated connector which is waterproof and moisture-proof.

SUMMARY OF THE INVENTION

The invention provides a sealed connector for connecting insulated electric conductors together, said device also providing dielectric continuity of the conductor insulation in addition to electric continuity of the conductors, the connector comprising a connector sleeve having a conductive portion made of malleable material in which there is a cavity intended for accommodating a bared portion of each conductor to be connected as well as an insulated portion of said conductors, and an insulating covering which completely surrounds the conductive portion and is folded back inside that part of the cavity which accommodates the insulated portion of each conductor to be connected, said insulated portion of the conductor being held in the connector by crimping or the like.

BRIEF DESCRIPTION OF THE DRAWINGS

The figures of the accompanying drawings illustrate, by way of example, one embodiment of a connector in accordance with the invention.

DETAILED DESCRIPTION

Figures 1, 2:
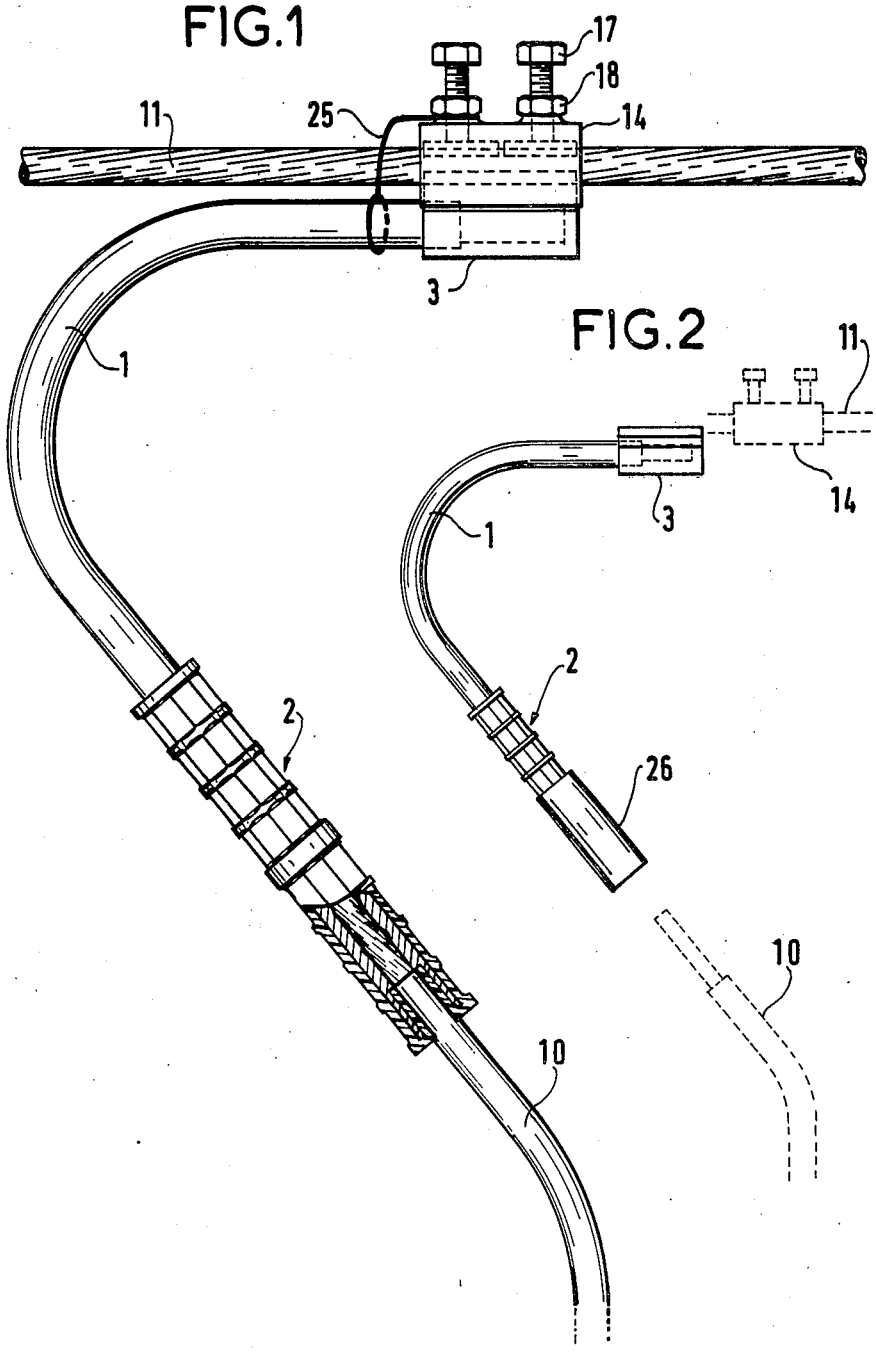
FIG. 1 shows a general view of a connector assembly with a partial cross-section through a connector sleeve.
FIG. 2 illustrates the connector assembly with its components separated, part of the connector sleeve remaining un-crimped for insertion of a drop wire.

The connector assembly illustrated in the figures comprises a length of insulated cable 1 for use as a drop wire link cable. One end of the cable 1 is equipped with a connector sleeve 2 and its other end equipped with a conducting end fitting 3.

The cable 1 is fixed in the sleeve 2 by crimping the sleeve onto the cable's insulative covering 4. A bared end portion 5 of the cable is clamped in a conductive portion 21 of the sleeve and the adjacent insulated portion 4 of the cable is crimped in the sleeve by the said conductive portion 21 in a sealed manner. The insulating outer covering 6 of the sleeve has an end portion 27 which is folded back inside the cavity which accommodates the insulated portion 4 of the cable 1.

Figure 3:
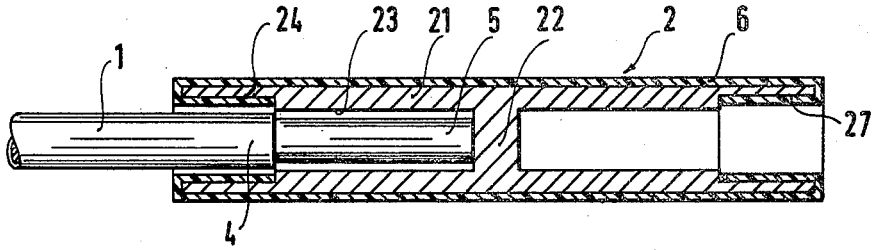
FIGS. 3 and 4 illustrate the connector sleeve 2, FIG. 3 being a cross-section of the sleeve before crimping and FIG. 4 being an outside view of the sleeve after crimping.
Figure 4:
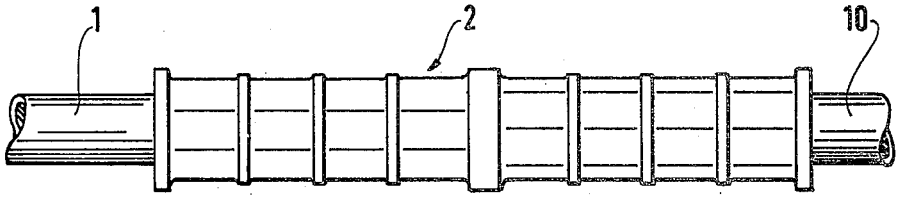
Figure 6:
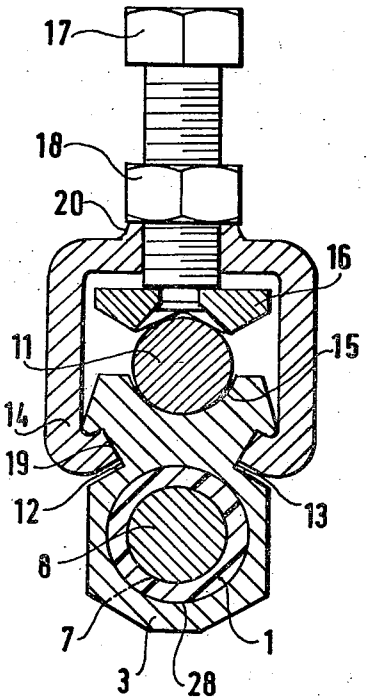
FIG. 6 is a cross-section view in plane VI—VI of FIG. 5.
Figure 5:
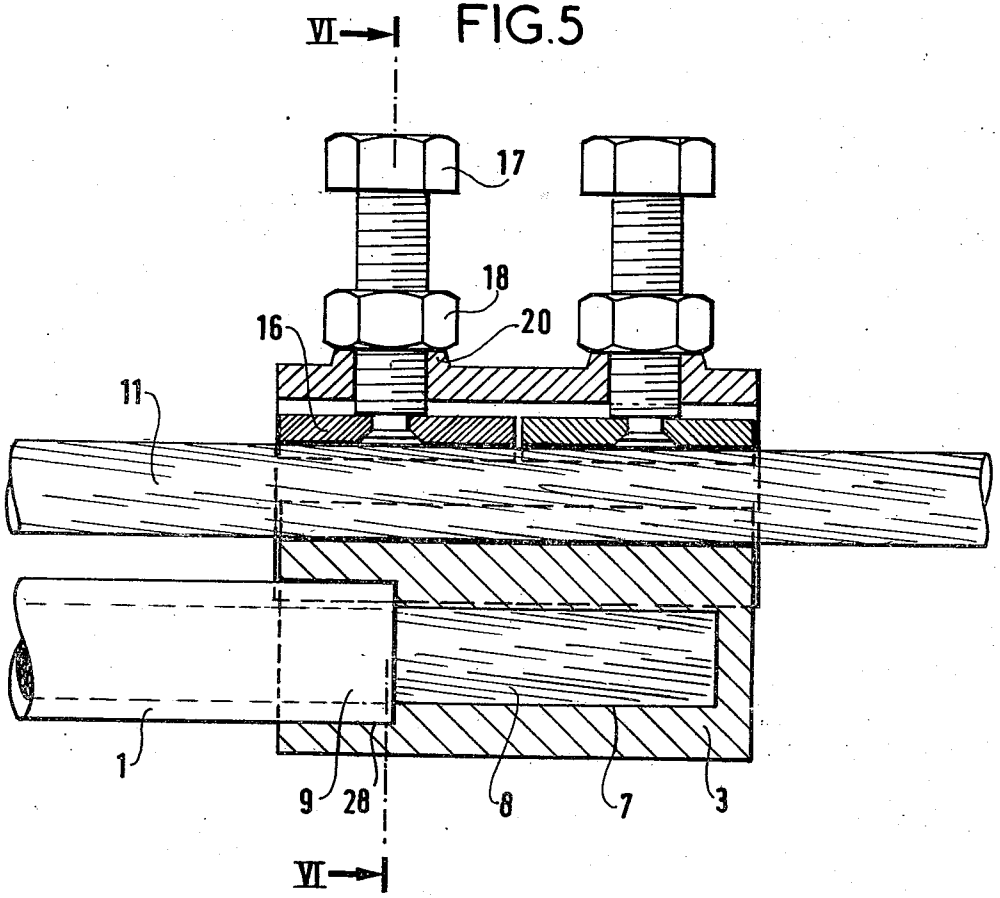
FIG. 5 is an elevation in cross-section of an end fitting for connection to an overhead line.

The sleeve 2 (FIG. 3) includes a conductive portion 21 of generally tubular shape, said conductive portion being made of malleable material. It has a middle partition 22 which acts as a stop to position the conductor inside the sleeve, an inner cavity 23 to accommodate the bared portion 5 of the conductor and an end cavity 24 of larger diameter to accommodate the folded back end portion 27 of the insulating covering 6 as well as the insulated portion 4 of the conductor. The insulating covering 6 completely envelops the conductive portion 21, its folded back end 27 being turned towards the cavity 23, and compresses the insulated portion 4 of the conductor 1 thereby providing proper sealing when the conductor 1 is positioned in the sleeve 2.

After crimping over the cable insulation 4, the cable 1 is held mechanically in the sleeve 2.

The conductive portion 21 and the insulating covering 6 are preferably assembled by moulding over; but they could alternatively be assembled by gluing, welding or by relying on the elasticity of the insulating material.

The conductive portion 21 may be made e.g. of copper, of aluminium, or of an alloy of these metals; the insulating covering 6 is made in a single piece of deformable material (e.g. polyamide or heat shinkable PVC) which can mechanically withstand the pressure forces developed during the crimping operation.

The other end of the cable 1 is crimped in the conductive end fitting 3 which has a recess 7 intended to accommodate said end. A bared end portion 8 of the cable is clamped in the end fitting and the adjacent insulated portion 9 is clamped in a recess 28 with a larger diameter in a sealed manner. Said conductive end fitting 3 also has two grooves 12 and 13 in which teeth 19 of a U bar 14 slide and a cradle 15 which rests on the overhead cable 11. The U bar is fixed on the cable 11 by a shoe 16 whose shape matches that of the cable. Said shoe is clamped by a screw 17 with a lock nut 18 to prevent loosening.

Two separate shoes—one per screw—enable independent clamping and better electrical contact between the conductive core of the cable and the cradle of the end fitting.

The threaded bores in the U bar are extended by extensions such as 20.

The conductive end piece 3 presses directly against the core of the cable. This allows direct contact between the overhead cable and the drop wire link cable.

An insulating tag 25 with one end passing round the drop wire link cable 1 and its other end round one of the screws 17 prevents the U bar from getting lost before the drop wire link cable is attached to the overhead cable.

As shown in FIG. 2, the sealed connector in accordance with the invention allows rapid connection of a drop wire cable proper 10 to an overhead line 11. It is necessary only to pass the U bar 14 over the overhead line 11, to slide the conductive end fitting 3 into the U bar 14 and to tighten the screws, then to fix the drop wire proper 10 by crimping it inside the noncrimped portion 26 of the sleeve 2.

The end fitting 3 is preferably made of the same metal as the conductor of the overhead cable 11 or of a compatible metal.

The dimensions of the end fitting 3 are a function of the diameter of the overhead cable 11 and of the number of screws of the U bar 14.

I claim:

1. A sealing connector for connecting insulated electric conductors together, said connector also providing dielectric continuity of the conductor insulation in addition to electric continuity of the conductors, said connector comprising a connector sleeve having a conductive portion made of malleable material bearing a cavity including a small diameter part remote from the end of the sleeve for accommodating a bared portion of a conductor to be connected and a larger diameter portion axially outwardly thereof for accommodating an insulated portion of said conductor, and an insulating covering which completely surrounds the conductive portion and is folded back inside the larger diameter part of said cavity at said end for accommodating the insulating portion of each conductor to be connected, and said insulated portion of the conductor and said folded back portion of said covering being commonly crimpable in the connector.

2. A connector according to claim 1, wherein the conductive portion and the insulating covering of the sleeve are assembled by moulding over.

3. A connector according to claim 1, wherein the conductive portion and the insulating covering of the sleeve are assembled by gluing, welding or the like.

4. A connector according to claim 1, wherein the conductive portion and the insulating covering of the sleeve are assembled by elastic clamping of the insulating material.

5. A connector assembly for connecting an insulated drop wire conductor to a bare overhead cable, said connector assembly comprising a sealed connector for connecting insulated electric conductors together, said connector also providing dielectric continuity of the conductor insulation in addition to electric continuity of the conductors, said connector comprising: a connector sleeve having a conductive portion made of malleable material bearing a cavity including a small diameter part remote from the end of the sleeve for accommodating a bared portion of a conductor to be connected and a larger diameter part axially outwardly thereof for accommodating an insulated portion of said conductor, and an insulating covering which completely surrounds the conductive portion and which is folded back inside the large diameter part of the cavity which accommodates the insulated portion of each conductor to be connected, and said insulated portion of said conductor and said folded back portion of said covering being commonly crimped in the connector and a conductive end fitting sealably crimped to the other end of said drop wire link conductor and encompassing in part the conductor insulation, said conductive end fitting being inserted in a U bar placed around the overhead cable so as to form a direct contact between the conductive end fitting and the overhead cable, said U bar comprising at least two independent shoes pressing the cable on the end fitting so as to insure direct contact between the overhead cable and the end fitting.

6. A connector assembly according to claim 5, wherein the end conductive fitting includes a cavity, and two grooves within the conductive fitting and wherein said U bar includes teeth which are inserted in said grooves respectively, and said conductive fitting further comprises a cradle for accommodating the overhead cable.

* * * * *